US005470201A

United States Patent [19]

Gilbert et al.

[11] Patent Number: 5,470,201

[45] Date of Patent: Nov. 28, 1995

[54] MOLTEN METAL PUMP WITH VANED IMPELLER

[75] Inventors: Ronald E. Gilbert, Chardon; George S. Mordue, Ravenna; Chris T. Vild, Cleveland Heights, all of Ohio

[73] Assignee: Metaullics Systems Co., L.P., Solon, Ohio

[21] Appl. No.: 312,327

[22] Filed: Sep. 26, 1994

Related U.S. Application Data

[63] Continuation-in-part of Ser. No. 898,043, Jun. 12, 1992, abandoned.

[51] Int. Cl.[6] ..... F04D 7/06

[52] U.S. Cl. ..... 415/200; 416/185; 416/241 B

[58] Field of Search ..... 415/200; 416/185, 416/223 B, 241 B

[56] References Cited

U.S. PATENT DOCUMENTS

| | | | |
|---|---|---|---|
| 2,054,923 | 9/1936 | Betterton et al. . | |
| 2,072,650 | 3/1937 | Schmeller, Sr. . | |
| 2,528,210 | 10/1950 | Stewart | 415/88 |
| 3,227,547 | 1/1966 | Szekely | 75/558 |
| 3,573,895 | 4/1971 | Östberg . | |
| 3,650,513 | 3/1972 | Werner . | |
| 3,690,621 | 9/1972 | Tanaka et al. | 416/186 |
| 3,767,382 | 10/1973 | Bruno et al. | 75/68 R |
| 3,776,660 | 12/1973 | Anderson et al. | 415/196 |
| 3,791,813 | 2/1974 | Ramachandran et al. . | |
| 3,792,848 | 2/1974 | Östberg . | |
| 3,814,396 | 6/1974 | DiGregorio et al. . | |
| 3,839,019 | 10/1974 | Bruno et al. . | |
| 3,861,660 | 1/1975 | Ammann et al. . | |
| 3,871,872 | 3/1975 | Downing et al. | 75/61 |
| 3,887,172 | 6/1975 | Funck et al. . | |
| 3,953,552 | 4/1976 | Strauss . | |
| 3,984,234 | 10/1976 | Claxton | 415/200 |
| 4,188,287 | 2/1980 | Faulkner et al. . | |
| 4,283,357 | 8/1981 | Sidery . | |
| 4,287,137 | 9/1981 | Sonoyama et al. . | |
| 4,297,214 | 10/1981 | Guarnaschell | 210/219 |
| 4,351,514 | 9/1982 | Koch | 266/217 |
| 4,425,232 | 1/1984 | Lawrence et al. . | |
| 4,426,068 | 1/1984 | Gimond et al. . | |
| 4,454,078 | 6/1984 | Engelbrecht et al. | 261/93 |
| 4,470,846 | 9/1984 | Dubé . | |
| 4,491,474 | 1/1985 | Ormesher | 75/65 R |
| 4,518,424 | 5/1985 | Ormesher | 75/65 R |
| 4,592,658 | 6/1986 | Claxton | 366/265 |
| 4,607,959 | 8/1986 | Miyazaki et al. | 366/343 |
| 4,664,592 | 5/1987 | Grzina . | |
| 4,673,434 | 6/1987 | Withers et al. | 75/61 |
| 4,786,230 | 11/1988 | Thut | 415/88 |
| 4,940,384 | 7/1990 | Amra et al. | 415/121.2 |
| 5,025,198 | 6/1991 | Mordue et al. . | |
| 5,028,211 | 7/1991 | Mordue et al. | 416/204 R |
| 5,078,572 | 1/1992 | Amra | 415/121.2 |
| 5,088,893 | 2/1992 | Gilbert et al. | 415/200 |
| 5,092,821 | 3/1992 | Gilbert et al. . | |
| 5,165,858 | 11/1992 | Gilbert et al. | 416/223 B |
| 5,181,828 | 1/1993 | Gilbert et al. | 415/200 |
| 5,192,193 | 3/1993 | Cooper et al. . | |
| 5,268,020 | 12/1993 | Claxton | 75/708 |
| 5,308,045 | 5/1994 | Cooper | 416/237 |
| 5,310,412 | 5/1994 | Gilbert et al. | 75/571 |
| 5,330,328 | 7/1994 | Cooper | 417/424.1 |

FOREIGN PATENT DOCUMENTS

| | | | |
|---|---|---|---|
| 1024602 | 1/1953 | France | 415/200 |
| 1382504 | 11/1964 | France . | |
| 2376310 | 12/1977 | France | 415/200 |

OTHER PUBLICATIONS

"Fluid Mechanics", Frank M. White; Second Edition, pp. 633–642 (©1986).

*Primary Examiner*—Edward K. Look
*Assistant Examiner*—Michael S. Lee
*Attorney, Agent, or Firm*—Fay, Sharpe, Beall, Fagan, Minnich & McKee

[57] ABSTRACT

A molten metal pump including a vaned impeller having a larger outlet area than inlet area which demonstrates prolonged high effectiveness and reduces the likelihood of catastrophic failure.

14 Claims, 6 Drawing Sheets

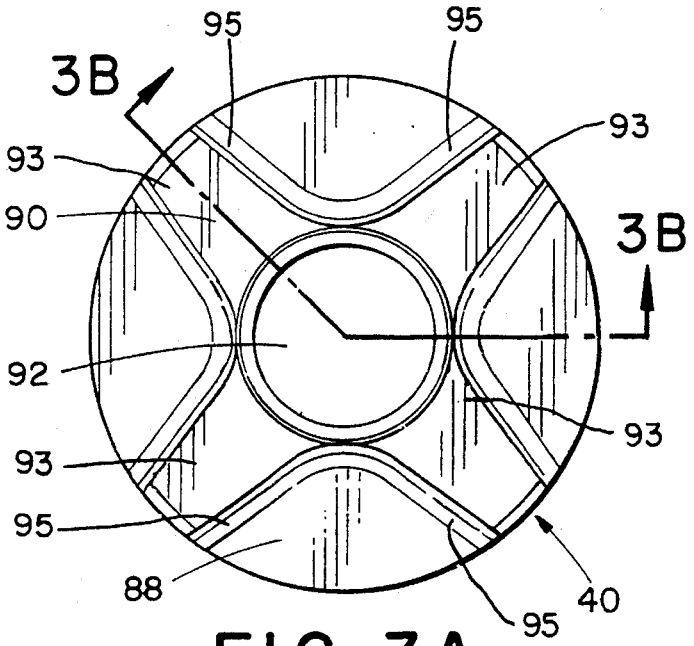
FIG. 3A
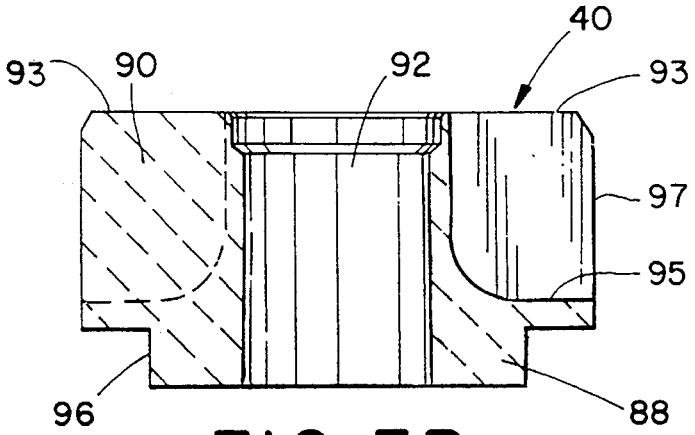
FIG. 3B
FIG. 3C
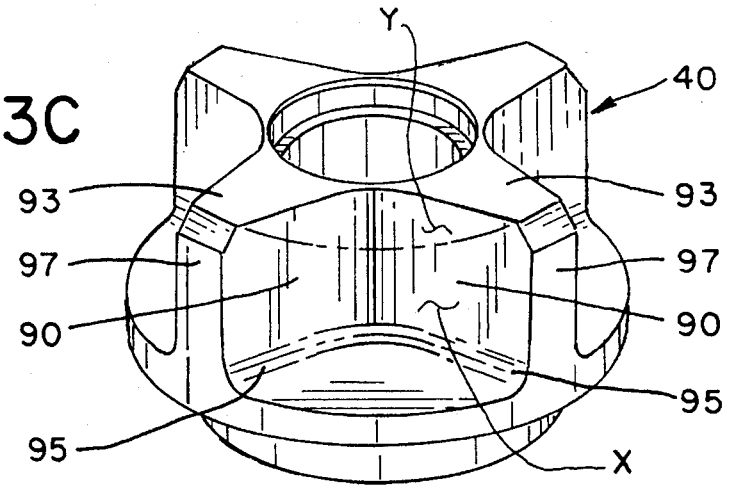

MOLTEN METAL PUMP WITH VANED IMPELLER

This application is a continuation-in-part of application Ser. No. 07/898,043 filed Jun. 12, 1992, now abandoned.

FIELD OF THE INVENTION

This invention relates to molten metal pumps, and more particularly, to pumps utilizing a vaned impeller.

BACKGROUND OF THE INVENTION

In the processing of molten metals, it is often necessary to pump molten metal from one place to another. When it is desired to remove molten metal from a vessel, a so-called transfer pump is used. When it is desired to circulate molten metal within a vessel, a so-called circulation pump is used. When it is desired to purify molten metal disposed within a vessel, a so-called gas injection pump is used. In each of these pumps, a rotatable impeller is disposed, preferably within a volute case, accessible to the molten metal in the vessel. Upon rotation of the impeller within the volute, the molten metal is pumped as desired in a direction permitted by the volute.

In each of the pumps referred to, the impeller is disposed within the volute formed in a base member. Typically, the base member is suspended within the molten metal by means of posts. The impeller is supported for rotation in the base member by means of a rotatable shaft connected to the drive motor with a coupling. The base member includes an outlet passage in fluid communication with the impeller, and upon rotation of the impeller, molten metal is drawn into the volute and an open section of the impeller, where it then is discharged under pressure to the outlet passage.

Molten metal pump designers are generally concerned with efficiency and effectiveness. For a given diameter impeller, pump efficiency is defined by the work output of the pump divided by the work input of the motor. The equally important quality of effectiveness is defined as molten metal flow per impeller revolutions per minute.

Although pumps previously known in the art operate satisfactorily to pump molten metal from one place to another, certain problems have not been completely addressed. Particularly, these problems relate to the effectiveness of the impeller, duration of operability and consistency of performance.

U.S. Pat. No. 4,940,384, herein incorporated by reference, shows a molten metal pump with a cup-like impeller body having vanes and lateral openings for moving molten metal. Although the impeller of this pump transports molten metal, it is prone to clogging by foreign materials such as semi-solids and solids, e.g. drosses, refractory debris, metallic inclusions, etc., (herein after referred to as "particles") contained in the vessel and frequently drawn into the molten metal pump. If a large particle is drawn into the pump, the impeller can be jammed against the volute case, causing catastrophic failure of the pump. Even if catastrophic failure does not occur, small particles eventually clog the lateral openings and degrade the performance of the impeller by reducing the volume of molten metal it can transfer. Accordingly, it is desirable in the art to have an impeller which minimizes clogging, thereby maintaining high efficiency over time and avoiding catastrophic failure.

U.S. Pat. Nos. 3,776,660 and 5,192,193 also teach molten metal impellers, however these designs have more extensive vanes than U.S. Pat. No. 4,940,384. Nonetheless, each of U.S. Pat. Nos. 3,776,660 and 5,192,193 continue to suggest an impeller design having a larger inlet area than outlet area. Accordingly, the problem of clogging is not overcome by these designs. Moreover, it is easy to envision a particle of debris having a size which enters the inlet, adjacent the impeller center, but too large to pass through the narrower passages between the vanes. This particle then bounces around the impeller inlet, reducing flow and degrading the vanes.

Impeller-type equipment without lateral openings has been utilized in molten metal stirring and/or submersion types of devices. U.S. Pat. No. 4,898,367 shows a gas dispersion rectangular block without openings. However, this stirring device does not achieve a directed, forced fluid flow. Particularly, the impeller must be rotatable within a housing to maximize forced flow from the impellers rotation. In addition to block type molten metal agitation devices, vaned circular equipment has been used, see U.S. Pat. No. 3,676,382. Again, however, there is no means for achieving forced directional molten metal flow. Such forced directional molten metal flow is highly necessary in the application of pumping technology to molten metal processing. For example, in a circulation mode, better convectional heat transfer occurs (greater kinetic energy imparted by the pump), and faster melting exists as solid charge materials such as scrap or ingot is mixed more quickly and thoroughly into and with the liquid metal. In a transfer mode, the liquid metal is more strongly directed or redirected into a conveying conduit such as a riser or pipeline for more efficient transfer at a higher rate as a result of such improved forced directional molten metal flow. In a gas injection mode, treatment with gas is more readily achieved with a contained molten metal flux.

In summary, the molten metal treatment art described in the above paragraphs fails to achieve important advantages of the current invention. Particularly, either there is not effective prevention of clogging and/or there is no means to achieve directional forced molten metal flow.

The current invention achieves a number of advantages in directional forced molten metal flow. For example, the impeller of the current pump is not prone to clogging of lateral openings as in the prior pump impellers. Accordingly, catastrophic failure is much less likely to occur and the effectiveness of the impeller operation does not degrade as rapidly over time. The design also achieves high strength by increasing the load area material thickness. Furthermore, the impeller design can be prepared with easy manufacturing processes. Accordingly, the cost of production is reduced and accommodates a wide selection of impeller material, such as graphite or ceramic. Also, the current impeller invention is adaptable to allow optimization as required without large scale manufacturing alteration.

SUMMARY OF THE INVENTION

Accordingly, it is the primary object of this invention to provide a new and improved molten metal pump.

It is a further objective of this invention to provide a new and improved impeller for use in a molten metal pump.

To achieve the foregoing objects and in accordance with the purpose of the invention as embodied and broadly described herein, the molten metal pump of this invention comprises an elongated drive shaft having first and second ends, the first end extending out of a molten metal bath and the second end extending into the molten metal bath. An impeller is attached to the second end of the drive shaft. The impeller has a solid base portion with at least one face and at least two vanes extending substantially perpendicular from the face. The vanes extend radially from the center of the face and are positioned to create a smaller impeller inlet area than impeller outlet area.

The impeller is disposed within a pumping chamber having an inlet into which molten metal can be drawn and an outlet through which molten metal can be forcibly discharged by the impeller's rotation. Preferably, the pumping chamber is a volute.

Volute, as used herein, means a casing which facilitates the impeller's convergence and expulsion of molten metal. Solid, as used herein, means a lack of openings capable of accommodating molten metal flow. More particularly, sold means imperforate. Face, as used herein, means a relatively flat surface.

BRIEF DESCRIPTION OF THE DRAWINGS

FIG. 3A is a top view of the impeller of FIGS. 1 and 2 and

FIG. 3B is a cross-sectional view taken along line 3B; and

FIG. 3C is a perspective view of the impeller of FIGS. 1, 2, 3A and 3B

DETAILED DESCRIPTION OF THE INVENTION

While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined by the appended claims.

Figure 1:
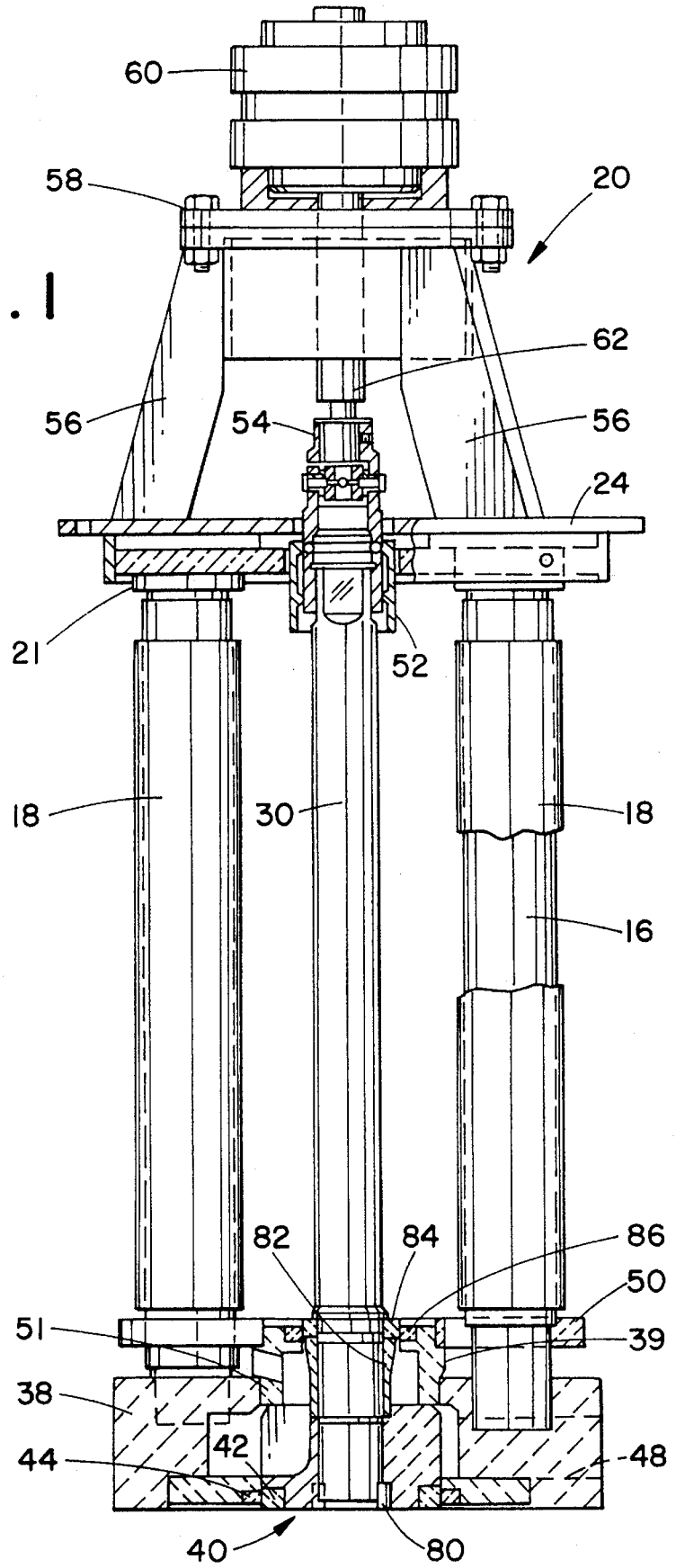
FIG. 1 is a cross-sectional view of a molten metal pump.
Figure 2:
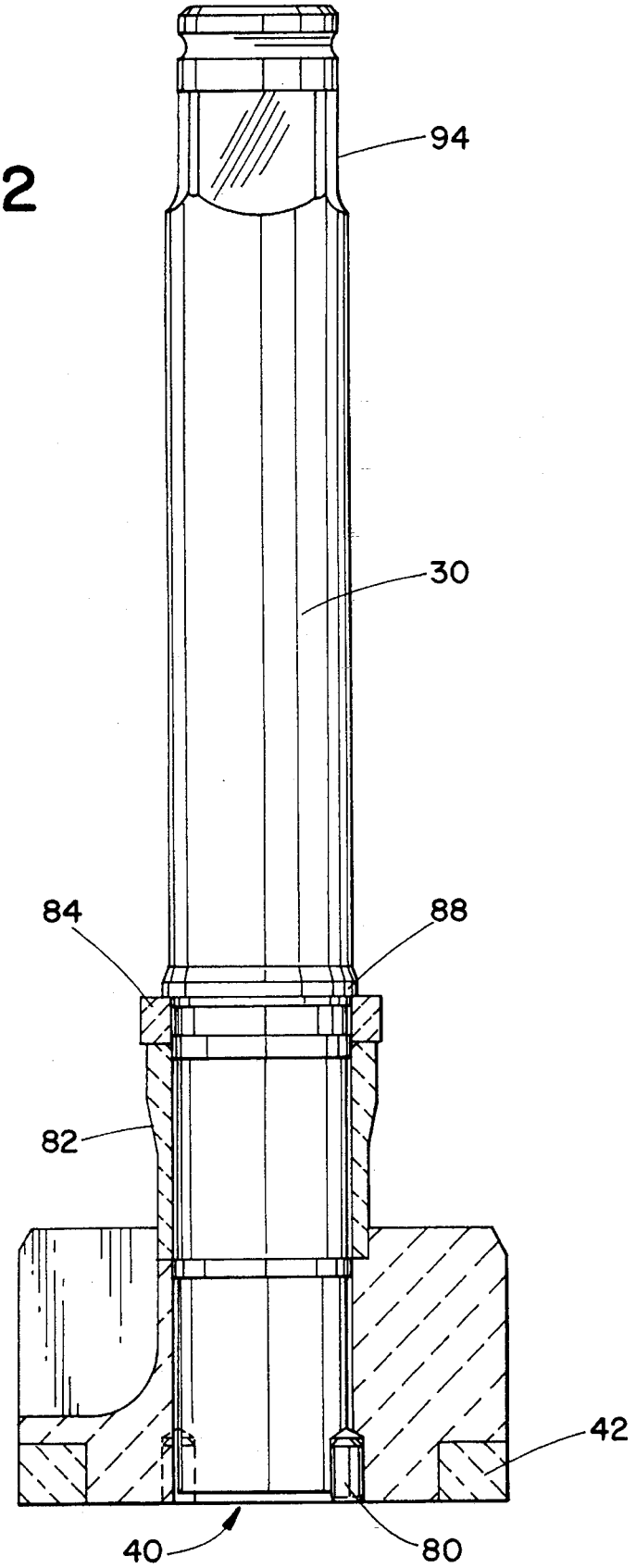
FIG. 2 is a cross-sectional view of an impeller attached to a drive shaft for use in a molten metal pump.

Referring now to FIGS. 1 and 2, a molten metal pump according to the invention is indicated generally by the reference numeral 20. The pump 20 is adapted to be immersed in molten metal contained within a vessel (not shown). The vessel can be any container holding molten metal.

It is to be understood that the pump can be any type of pump suitable for pumping molten metal. Generally, however, the pump 20 will have a base member 38 within which an impeller 40 is disposed. The impeller 40 is supported for rotation within the base member 38 by means of an elongated, rotatable shaft 30. The upper end of the shaft 30 is connected with shaft 62 to a motor 60. The motor 60 can be of any desired type, for example air or electric. The pump 20 is supported by means of posts 16, including protective post sleeves 18, and a support plate 24 attached via post sockets 21. The motor is positioned above the support plate 24 with struts 56 and a motor support platform 58. The drive shaft 30 and posts 16 are typically made of graphite, with a refractory coating of boron nitride. A particularly preferred graphite is Metaullics Systems Co., L.P., 31935 Aurora Road, Solon, Ohio 44139, ZX grade graphite.

The base member 38 includes an outlet passageway 48. A riser, to form a transfer pump, could be connected to the base member 38 in fluid communication with the passageway 48. Alternatively, a gas injection pump could be assembled by including a gas injection apparatus with outlet passageway 48. The pump 20 is best described as a so-called circulation pump, that is, it circulates molten metal within the vessel.

As indicated earlier, however, the pump 20 is described for illustrative purposes and it is understood that the pump 20 can be of any type suitable for pumping the molten metal. Although the pump 20 is shown as a top feed, a particular advantage of the present impeller is its functionality in a bottom feed pump. Particularly, bottom feed pumps generally ingest a greater quantity and size of particles which make impeller clogging a significant problem. This inventive impeller reduces such problems to an extent which makes bottom feed pumps practical. As will be understood by those skilled in the art, a variety of pump designs are suitable for use with the inventive impeller. For example, a bottom feed pump may be especially long lived because prior art impellers which clog with dross and debris are not suitable to the harsher treatment of bottom feed whereas the subject impeller is not readily effected by the "dirty" aluminum more often encountered in a bottom feed pump.

Notwithstanding this improved performance, the base member 40 may include a baffle plate 50 and a shaft mount bearing 51 to reduce exposure of the impeller to debris.

The impeller 40 is secured via cement, such as Frakset, obtainable from Metaullics Systems Co., L.P. A first bearing ring 42 of silicon carbide or other material having bearing properties at high temperature is disposed about the lower most end of the impeller 40. A second bearing ring 44 of silicon carbide or other material having bearing properties at high temperature is disposed at the lower most end of the base member in facing relationship to the first bearing ring 42.

As will be apparent from the foregoing description, the impeller 40 is rotatable relative to the base member 38. The bearing rings 42 and 44 will prevent friction related wear of the base member 38 and the impeller 40 from occurring. This base member 38 includes volute case 39 within which the impeller 40 is disposed.

The upper, or first end 94 of the drive shaft 30 is connected to the motor 60 via coupling assembly 52, including torque limiting device 54 as shown in U.S. Pat. No. 5,092,821. Preferably, the drive shaft is of a quadralobal nature, as described in U.S. Pat. No. 5,092,821, herein incorporated by reference.

In addition to cement attachment of the impeller to the drive shaft 30, the impeller is secured to the drive shaft via graphite dowel pins 80. The impeller is further secured to the shaft 30 via a back-up sleeve 82 which acts as reinforcement to the attachment joint and as a locator for the impeller. Both of these embodiments are covered in U.S. Pat. No. 5,025,198, herein incorporated by reference.

A further bearing ring 84, comprised of silicon carbide or other thermally resistant bearing material, encircles the upper most portion of the back-up sleeve 82. This bearing ring 84 is opposed by another bearing ring 86 on baffle plate 50. The back-up sleeve 82 is generally affixed to the shaft 30 and prevented from upward movement via a collar ring 88 on the shaft 30.

Referring now to FIGS. 3A and 3B, the impeller 40 is shown as a four-vaned circular based impeller. The impeller consists of a circular base 88 with four vanes 90 extending from a hub 92 constructed to mate with shaft 30, perpendicular to the face 88. Vane, as used herein, generally means a flat or curved object rotated about an axis that causes or redirects fluid flow. In addition as used herein, vane means an independent surface imparting work on the molten metal. The impeller has a recessed based portion 96 for attachment of silicon carbide bearing ring 42. Typically, the vanes are tapered with the thickest section beginning at the center most portion of the impeller adjacent the hub/shaft. The tapering and the thickness of the vanes influence the wear from inclusions and/or sediment in the molten metal and molten metal fluid volume. Particularly, the thickness and the dimensions facilitate the durability of the vanes under stress.

Figure 9:
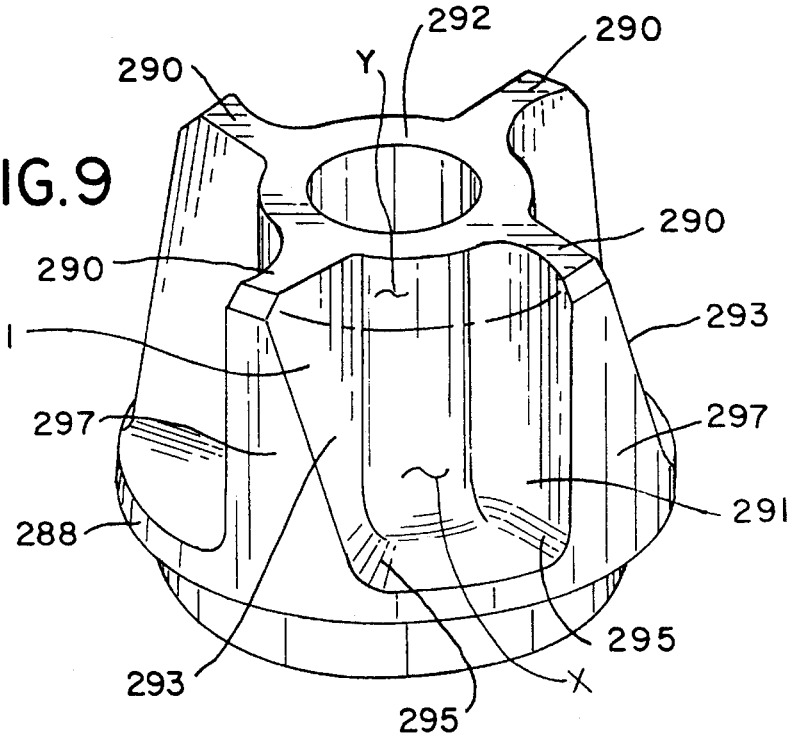
FIG. 9 is a perspective view of an alternative impeller embodiment having forward curved vanes.

An important attribute of the impeller design is a larger outlet area "X—X" than inlet area "Y—Y". Referring also to FIGS. 3C and 9, references to FIG. 9 being shown in "( )", the inlet and outlet areas of the impeller are particularly evident. Specifically, each vane 90 (291) includes a first edge 95 (295) disposed on the base 88 (288), a second edge 93 (290) and a third edge 97 (297). Accordingly, the second edge 93 (290) of adjacent vanes 90 (291) define an inlet "Y" to the impeller over their entire radial dimension, i.e. from the hub to the radial periphery of the impeller. Similarly, the third edge 97 (297) of adjacent vanes 90 (291) defines the radial outlet "x" of the impeller 40 throughout their entire axial dimension, i.e. from base 88 (288) to the top of the impeller. As is apparent, the inlet area is less than the outlet area. The inlet "Y—Y" area is generally adjacent an upper surface 93 of the impeller blades 90 and is generally adjacent the hub 92 where the lowest pressure occurs. In a bottom feed molten metal pump, the upper surface 93 would face the bottom of the pump and the hub is in the non-vaned surface (best seen in FIG. 5). By maintaining a large exit area and smaller inlet area, all particles ingested into the impeller can be expelled.

Figure 4:
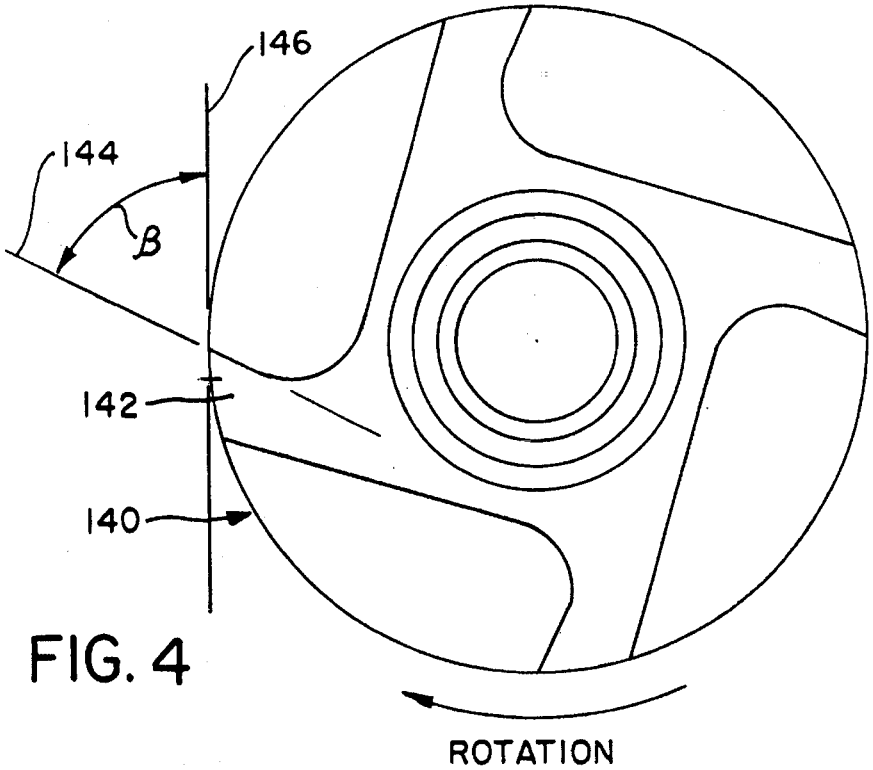
FIG. 4 is a top view of an alternative impeller embodiment showing forward curved vanes.

In addition to the problems prevented by particles in the molten metal, cavitation is believed to be another cause of degradation to the vanes of the impeller and a contributor to reduced effectiveness. In this regard, the forward curve embodiment of FIG. 4 has been found to produce at least a 7% higher flow rate per revolutions per minute (rpm) and can run at at least a 7% higher rpm with reduced cavitation, extending the life of the impeller. The forward curve used herein can be defined generally as an aspect of the vane wherein the curve of the terminal portion on the leading edge of the vane as shown by line 144 creates an acute angle $\beta$ relative to a tangent 146 on the perimeter of the impeller at its intersection with the vane. Forward is defined relative to the direction of rotation of the impeller.

This result with a forward curve vane is surprising because cavitation is generally believed to be more easily reduced with a backward curve or radial blade design. However, Applicants have found that in a molten metal environment, a forward curved blade is preferable.

Without being bound by theory, it is believed that molten metal pumps, due to the density of molten metal, have different requirements. Particularly, in a water environment, given diameter impellers are designed to increase efficiency by maximizing speed of rotation. In contrast, in a molten metal pump environment, it is desirable to achieve a maximum flow with a minimum speed of impeller rotation. In this case, a forward curved impeller is believed to be beneficial.

This is supported by the test data of Table I. In each of Examples 1–6 a L-25 molten metal circulation pump was used in a water bath.

Example 1 is a water test showing effectiveness of an impeller design as shown in FIG. 3A. Example 2 is a water test showing effectiveness of an impeller which is the mirror image of the design shown in FIG. 5, installed in a top feed pump. Example 3 demonstrates the effectiveness of the impeller of FIG. 4.

TABLE I

| | Flow in Gallons per Minute (GPM) | | |
|---|---|---|---|
| RPM | 1 | 2 | 3 |
| 300 | 165 | 127.5 | 180 |
| 600 | 300 | 247.5 | 337.5 |
| 900 | 450 | 375 | 495 |

Figure 8:
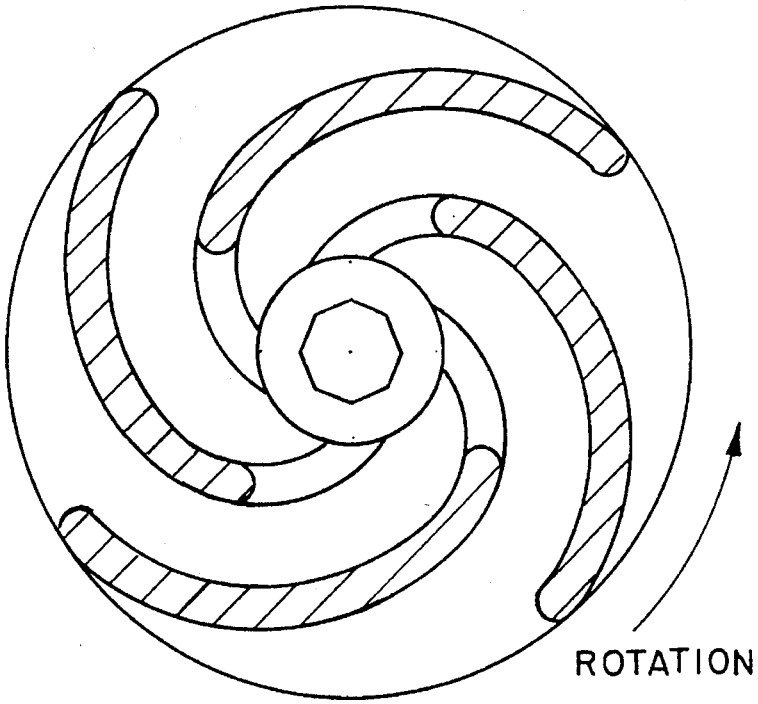
FIG. 8 (PRIOR ART)
FIG. 8 is a top view of a prior art impeller similar to FIG. 7, however, with a larger inlet area than outlet area.

As seen in Table II, the design of the current invention is significantly superior to that of the prior art design shown in FIG. 8. More particularly, the impeller design of FIG. 5 for a top feed pump was evaluated relative to a prior art impeller design.

Figure 5:
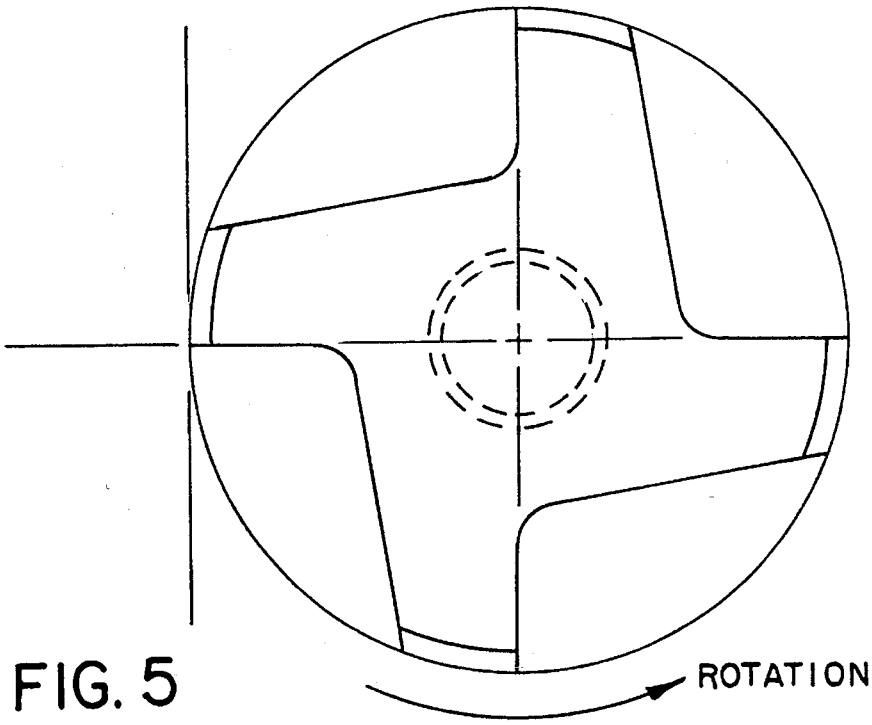
FIG. 5 is a top view of an alternative impeller embodiment for a bottom feed pump.
Figure 7:
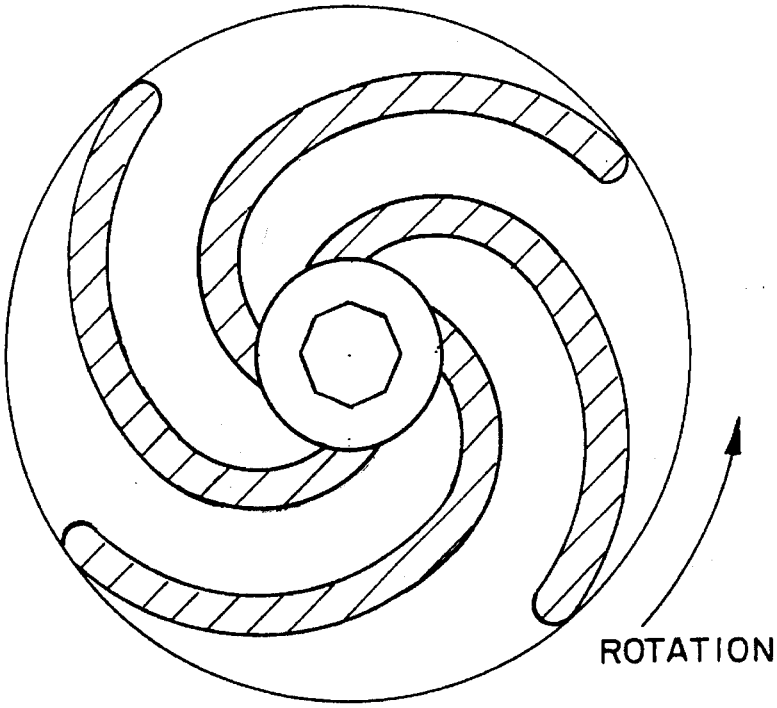
FIG. 7 is a top view of a alternative impeller embodiment having curved vanes.

Example 4 is a water test of the impeller shown in FIG. 7. Example 5 is a water test of an alternative version of the prior art design impeller with relieved vanes adjacent the hub as shown in FIG. 8. Example 6 demonstrates an impeller design of the current invention (FIG. 5).

TABLE II

| | Flow in GPM | | |
|---|---|---|---|
| RPM | 4 | 5 | 6 |
| 200 | 67.5 | 75 | 112.5 |
| 400 | 142.5 | 135 | 232.5 |
| 600 | 210 | 202.5 | 337.5 |
| 800 | 270 | 277.5 | 450 |
| 1000 | 330 | 345 | 577.5 |

Figure 6:
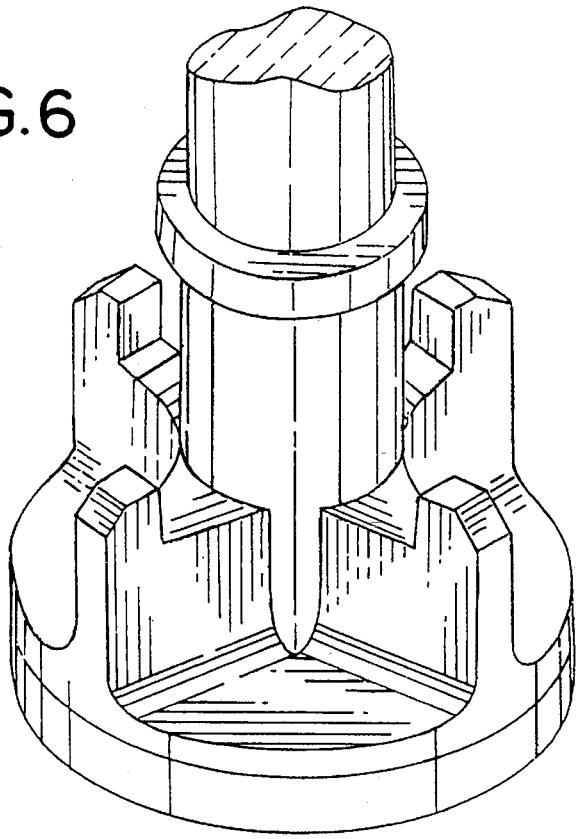
FIG. 6 is an elevational view of an alternative impeller embodiment having four relieved vanes.

FIG. 6 demonstrates an alternative impeller design. Relief of a portion of the vanes near the shaft/hub provides increased fluid access, however, mechanical strength is somewhat reduced.

FIG. 9 illustrates a particularly preferred impeller embodiment having four vanes 290 extending from a hub 292. In this embodiment each vane 290 is forward curved in a manner similar to that shown in FIG. 4. In addition, each vane includes a slanted back wall 293.

It will be appreciated from the foregoing descriptions that the molten metal pump according to the invention, possesses the advantages of high efficiency and durability. Particularly, the impeller in relationship to the described shaft and motor mechanism is effective in the transfer of molten metal with reduced clogging and/or catastrophic failure.

Thus it is apparent that there has been provided in accordance with the invention, a molten metal pump that fully satisfies the objects, aims, advantages set forth above. While the invention has been described in conjunction with specific embodiments thereof, it is evident that many alternatives, modifications, and variations will be apparent to those skilled in the art in light of the foregoing description.

Accordingly, it is intended to embrace all such alternatives, modifications, and variations as fall within the spirit and broad scope of the appended claims.

Having thus described the invention, it is claimed:

1. A molten metal pump comprising:

(a) a shaft having first and second ends;

(b) a means for rotating said shaft in communication with said first end of said shaft;

(c) an impeller in communication with said second end of said shaft;

(d) a volute housing said impeller, wherein said volute has a first opening through which molten metal can be drawn and a second opening through which molten metal can be discharged; and (e) said impeller comprising an imperforate substantially circular base having a surface facing toward a first end of the shaft, and at least two imperforate vanes connected to and extending substantially perpendicular from said surface and extending radially from said shaft or a hub securing said shaft toward a peripheral portion of said base, said vanes being spaced circumferentially apart;

each vane defining a first edge, a second edge and a third edge;

said first edge being disposed on said base;

said second edge defining an inlet end;

said third edge being a radially outer edge;

said second edge of adjacent vanes defining an inlet area over their entire radial dimension and being generally planar;

said third edges of adjacent vanes defining an outlet area; and said outlet area being greater than said inlet area.

2. The pump of claim 1 wherein said vanes of said impeller are straight.

3. The pump of claim 1 wherein said vanes of said impeller are forward curved.

4. The pump of claim 1 wherein said impeller is further comprised of three vanes.

5. The pump of claim 1 wherein said impeller is further comprised of four vanes.

6. The pump of claim 1 wherein said vanes of said impeller are thicker adjacent said face.

7. The pump of claim 1 wherein said vanes of said impeller are thicker adjacent said shaft.

8. The pump of claim 1 wherein said vanes of said impeller are slanted backward from its interface with said face.

9. The pump of claim 1 wherein said volute inlet is in the bottom of said housing.

10. The pump of claim 1 wherein said impeller is comprised of graphite.

11. The pump of claim 1 wherein said impeller is further comprised of a bearing ring surrounding said circular base.

12. The pump of claim 1 wherein said impeller vanes are arcuate.

13. The pump of claim 1 wherein said molten metal is aluminum.

14. The pump of claim 1 wherein said molten metal is zinc.

* * * * *